US006208821B1

(12) United States Patent
Grune et al.

(10) Patent No.: US 6,208,821 B1
(45) Date of Patent: Mar. 27, 2001

(54) PHOTOSENSITIVE DRUM HAVING INJECTION MOLDED INSERT AND METHOD OF FORMING SAME

(75) Inventors: Guerry L. Grune, Virginia Beach; William Niederstadt, Chesapeake; Dennis Working, Norfolk, all of VA (US)

(73) Assignee: Mitsubishi Chemical America, Inc., Chesapeake, VA (US)

( * ) Notice: Subject to any disclaimer, the term of this patent is extended or adjusted under 35 U.S.C. 154(b) by 0 days.

(21) Appl. No.: 09/540,287

(22) Filed: Mar. 31, 2000

(51) Int. Cl.[7] ..... G03G 15/00
(52) U.S. Cl. ..... 399/159; 399/111; 399/116
(58) Field of Search ..... 399/159, 116, 399/113, 411, 111

(56) References Cited

U.S. PATENT DOCUMENTS

| | | | | |
|---|---|---|---|---|
| 5,470,635 | * | 11/1995 | Shirai et al. | 428/131 |
| 5,608,509 | * | 3/1997 | Shirai et al. | 399/351 |
| 5,619,309 | * | 4/1997 | Yoshiro et al. | 399/111 |
| 5,638,161 | * | 6/1997 | Numagami et al. | 399/111 |
| 5,669,042 | * | 9/1997 | Kobayashi et al. | 399/111 |
| 5,689,774 | * | 11/1997 | Shishido et al. | 399/111 |
| 5,739,900 | * | 4/1998 | Isobe | 355/109 |
| 5,966,566 | * | 10/1999 | Odagawa et al. | 399/109 |
| 6,035,163 | * | 3/2000 | Zona et al. | 361/225 |
| 6,064,842 | * | 5/2000 | Takeuchi et al. | 399/111 |
| 6,075,955 | * | 6/2000 | Cais et al. | 399/91 |
| 6,131,003 | * | 10/2000 | Cais et al. | 399/91 |

FOREIGN PATENT DOCUMENTS

2000089612 * 3/2000 (JP) .

* cited by examiner

*Primary Examiner*—Richard Moses
(74) *Attorney, Agent, or Firm*—Oblon, Spivak, McClelland, Maier & Neustadt, P.C.

(57) ABSTRACT

A photosensitive drum is provided with an insert by injecting a rapidly curing material directly into the drum such that when the material cures, a noise/vibration reducing insert is provided. The insert material can be injected by a reciprocating nozzle during the manufacture/assembly of the drum. By injecting the insert material into the drum when the drum is being manufactured/assembled, it is not necessary to separately design the insert or to procure tooling to separately manufacture the insert. In addition, the insert will closely conform to the interior of the drum since the insert is molded inside of the drum. In addition, modifications to the insert (e.g., to vary the mass or size of the insert) are readily achievable without tooling modifications.

20 Claims, 3 Drawing Sheets

PHOTOSENSITIVE DRUM HAVING INJECTION MOLDED INSERT AND METHOD OF FORMING SAME

TECHNICAL FIELD

The invention relates to image forming apparatus, and particularly to photosensitive drums in which an insert is provided during manufacturing, packaging and/or assembly for reducing noise and/or vibration.

BACKGROUND OF THE INVENTION

Discussion of Background

Image forming apparatus, such as printers or photocopiers, include a photosensitive member, typically in the form of a photosensitive drum. The performance of the photosensitive drum is of critical importance, since the image being produced (or reproduced) is formed and developed on the drum. The developed image is then transferred from the drum to, for example, a sheet of paper. Typically, the drum is formed of metal, such as aluminum, and the metal is anodized or coated to provide a thin dielectric layer. The drum is then coated with photo generation and photo conduction layers over the dielectric layer.

In forming an image, the drum is rotated, and a given location on the outer surface of the drum is thereby rotated past a charge roller, an exposure location, a developing location (at which toner is applied), a transfer location (at which the toner image is transferred from the drum to paper), and a cleaning location at which a cleaning blade removes excess toner from the drum so that the process can be repeated. During an image forming operation, as a result of the rotation of the photosensitive drum, and its interaction with the various other components of the image forming apparatus, noise and vibration can occur. For example, vibration (and associated noise) can occur from the rotation of the drum, and any imperfections of the drum, the gear flanges attached to the drum, and/or the drive that interacts with the gear flanges of the drum. Further, an alternating current (AC) electric field is applied to the charge roller, and the alternating current can also cause noise and/or vibration of the drum or between the drum and other components. Further, as the drum rotates past the cleaning blade (which is in contact with the drum), noise can be generated, particularly if the drum is vibrating. This interaction between the drum and cleaning blade is also known as chatter vibration or "stick-slip" vibration. (See, e.g., Chatter Vibration of a Cleaner Blade in Electrophotography, by Kawamoto, in the January/February 1996 issue of Journal of Imaging Science and Technology.)

The noise and vibration associated with operation of a photoconductive drum not only presents an annoyance to workers using (or in the vicinity of) the image forming apparatus, but also, the noise/vibration can lead to image deterioration, distortion, or damage to the apparatus. In particular, the vibration can result in poor performance or interaction between the photosensitive drum and one or more of the components with which the drum interacts, including the cleaning blade, the charge roller, the developer device, etc. For example, if the cleaning blade does not properly remove residual toner, undesirable toner spots can occur in subsequent images. Further, if the drum is not charged or developed properly, the resulting image can have white spaces where the image has not been properly formed, developed or transferred, or black spots where undesired toner has been transferred to the sheet of paper. Noise problems can also occur as a result of the generation of gases (ozone) which occurs during an image forming operation, however this noise is typically relatively small.

To reduce or eliminate noise and/or vibration, the physical characteristics of the drum can be modified, for example, by increasing the thickness of the drum. Thus, the drum can be designed so that its natural frequency differs from that of other components of the apparatus and/or that of the process cartridge (the unit within which the drum is disposed). As a result, the vibrations are eliminated or reduced, or the frequency of the noise which might occur can be shifted so that it is outside of the audible range. However, increasing the thickness of the tube or the "substrate" (that eventually would be coated to be used as an electrophotographic drum) can make the tube more expensive to manufacture, particularly if the tooling utilized to manufacture a tube must be replaced. Moreover, when photosensitive drums are manufactured as replacement parts, they will often be inserted into the process cartridges of another manufacturer. The process cartridge could be refurbished or a newly manufactured replacement process cartridge of a different manufacturer than that of the photosensitive drum, and the manufacturer/refurbisher of the process cartridge could change (or the design of a given manufacturer/refurbisher could change). Thus, it can be difficult to simply select a thickness of the tube which will be suitable for avoiding noise problems, since even if a thickness is selected for a certain process cartridge, that thickness could be unsuitable for another process cartridge. As a result, noise problems can be particularly problematic with photosensitive drums manufactured as replacement parts.

A further difficulty which can arise with photosensitive drums is that the roundness or circularity of the tube can vary over time, which can also lead to image deterioration. The roundness or circularity of the drum can more rapidly deteriorate if the drum is vibrating and contacting other components disposed about the drum. This problem can also be reduced by providing a thicker drum, however as discussed above, increasing the thickness of the drum can increase the materials and manufacturing costs, and/or the requirement for new tooling.

An alternate solution which has been utilized in the past for solving noise and/or vibration problems has been to insert plugs within the photosensitive drum. With this approach, a cylindrical object is inserted into the drum, and the insert provides additional weighting to the drum to alter the mass/frequency characteristics of the drum. However, the separate insertion of plug-type inserts is undesirable for a number of reasons. First, the plug is often required to be positioned at a precise location within the drum, which can complicate the manufacturing process. Further, the plug must be secured in place, which can require the use of an adhesive, thus further complicating the manufacture/assembly process. An interference fit can also be provided between the drum and plug, however, an interference fit could result in deformation of the drum. A further disadvantage that can occur with plug inserts, is that the plug and/or its associated adhesive, can alter the performance characteristics of the drum. Prior inserts have also been disadvantageous due to the costs associated with the design and manufacture of a separate part. In particular, the insert must be designed and capital costs are incurred in designing and purchasing the tooling required to manufacture a part which must be compatible in form and size with the photosensitive drum. The inserts must then be kept in inventory in sufficient quantities.

In view of the foregoing, a device and method are needed for reducing noise and/or vibration in an image forming apparatus, particularly noise and/or vibration associated with operation of a photosensitive drum. Such a device and method are preferably suitable for use in both original equipment and for replacement parts. In addition, such a device and method should preferably minimize the cost to manufacture the insert and a drum including such an insert and should also preferably simplify the manufacturing process.

SUMMARY OF THE INVENTION

It is an object of the present invention to provide a product and process for reducing noise and/or vibration in an image forming apparatus in a cost efficient manner.

It is another object of the invention to provide a device and method that eliminates or reduces noise or vibration which can occur during operation of original equipment or replacement photosensitive drums of an image forming apparatus.

It is a further object of the invention to provide a device and associated method that will provide for more reliable and consistent performance of a photosensitive drum in an image forming apparatus.

It is yet another object of the invention to provide a process for providing a noise and/or vibration reducing insert for a photosensitive drum that need not be bonded to the drum with an adhesive.

It is a still further object of the invention to provide a noise and/or vibration reducing insert for a photosensitive drum in which movement and damage due to thermal cycling that occurs in shipping and storage of the drum is reduced or eliminated.

The above and other objects and advantages are achieved in accordance with the present invention in which an insert is molded directly inside of a photosensitive drum. Thus, the insert is manufactured during the manufacture or assembly of the photosensitive drum and it is not necessary to separately manufacture, inventory and insert the noise/vibration reducing insert. Further, since the insert is molded directly inside of the drum, it conforms in size and shape to the inner periphery of the drum and it is not necessary to provide a separate adhesive for securing the insert in place inside of the drum. In accordance with the present invention, the material forming the insert is directly injected into the interior of the photosensitive drum to fill a portion of the interior of the drum with the insert material. Once the insert material cures, the step of providing the drum with a noise/vibration reducing insert is complete. The material which forms the insert can include a single or multiple part adhesive which is injected by appropriate means such that a predetermined, specified mass is provided at the proper location of any OPC drum. The insert material or materials can be selected to match or be compatible with the thermal coefficient of expansion of the OPC drum, while also being low in cost. Preferably, the injection and initial curing time of the injected thermoplastic or adhesive system selected are accomplished rapidly, preferably in less than 10 seconds and more preferably in less than 6 seconds. Such a rapid cure or solidification time helps to ensure that there is no occurrence of leakage or spillage out of the internal section of the OPC drum onto undesirable external surfaces and also minimizes delay in the drum manufacturing/assembly process. By metering a specified amount of the insert material, the exact mass (and therefore weight) of the insert can be predetermined. The injection of the insert material can also be controlled so that upon curing, the insert is disposed at the desired location inside of the drum. Thus, both the weight and location of the insert can be controlled to ensure that the insert is effective in reducing noise and/or vibration. The metering of the insert material directly into the drum to form the insert is also advantageous in that the size or mass of the insert can be varied (for different drums or as a design modification for a particular drum) without requiring modifications to manufacturing tooling as was the case with conventional preformed inserts.

Compatibility in terms of the thermal coefficient of expansion of the drum and the insert is important due to the conditions which a drum can be subjected to in shipping and storage. In particular, drums are often shipped in unheated cargo space and stored in non-air conditioned warehouses. Thus, if there is a poor match between the thermal coefficient of expansion of the drum with respect to the insert, the insert can be dislodged from the interior of the drum if the insert should shrink by an amount greater than that of the drum, or the insert can deform the drum if the insert should expand by an amount substantially greater than that of the drum. Preferably the drum and insert should be able to withstand a cycle of temperatures of from −40° C. to 80° C. It is to be understood that the thermal coefficient of expansion of the insert need not be identical to that of the drum as long as the thermal coefficients are sufficiently close to one another so that damage to the drum or insert is avoided for the conditions under which the drum is to be subjected. Thus, where the shipping and storage conditions are better controlled, the matching of the thermal coefficients need not be as closely matched. However, as discussed earlier, in view of typical storage and handling environments, the drum and insert should be able to withstand temperatures of from −40° C. to 80° C. without damage.

Examples of suitable materials include one or two-part adhesives filled with silica. The filler material assists in making the thermal coefficient of expansion of the insert closer to that of the drum, as compared with the thermal coefficient of expansion of an insert which did not include such a filler material. Filler materials are also relatively inexpensive, and therefore, also are beneficial in maintaining a low cost for the insert material. It is to be understood that filler materials other than silica (e.g., alumina) are also suitable. The addition of a filler material to the resin in amounts of as small as 5% (by weight) have been found to be advantageous in making the thermal characteristics of the insert closer to that of the drum. The addition of a filler material in amounts of up to 90% by weight have also produced satisfactory results. Filler amounts above 90%, while possible, are generally not preferred, since the insert material becomes paste-like and difficulties can be encountered in handling of the material so that the material can be injected and cured inside of a photosensitive drum.

The one or two-part adhesive resin and filler material inserts of the invention have been found advantageous in reducing the possibility that the insert will become loose during shipping and storage due to temperature variations and vibrations/impacts which can occur during shipping and storage. As noted above, cost reduction and better thermal matching can be achieved by the use of a filler material such as silica or alumina, since such filler materials are inexpensive and have thermal properties which are closer to that of the substrate of the photosensitive drum, which is typically aluminum or an aluminum based material. Rapid injection/curing speeds can be provided by the use of reaction injection molding (RIM) techniques whereby the curing reaction of two separate monomers takes place immediately within the cavity of the OPC drum. RIM processes allow for a wide selection of various polymers that would otherwise have to be preformed and inserted separately. Preferably monomers are selected such that exotherms do not exceed of 80° C. as the monomers react and cure. Extreme exotherms could cause damage to the surface coatings of the OPC drum. A small amount of shrinkage of the resin during curing is acceptable and the resin will nevertheless remain adhered to the inner surface of the OPC drum. However, if desired, expanding monomers can also be included in the resin material to compensate for shrinkage if excessive shrinkage should occur due to the resin materials selected for the insert. The addition of expanding monomers (or other expedients such as hollow spheres) is optional and need not be provided where shrinkage is not problematic. However, even with small amounts of shrinkage, expanding monomers can be added if desired. Preferably, the dimensions of the insert after curing are close to the inner diameter (I.D.) of the photosensitive drum for maximum internal contact area between the filled insert and the photosensitive drum to provide a better muffling effect.

An additional advantage of the invention is that, with the insert filling the internal portion of the drum, the insert can provide a supportive effect to the photosensitive drum, thereby rendering the drum more durable and less susceptible to deformation or deviation of the photosensitive drum from its circularity or roundness during use. This supportive effect is particularly desirable in that the trend is toward reducing the thickness of the photosensitive drums to correspondingly lower the cost of the drum. Such reduced thicknesses render the drum more susceptible to deformation. In accordance with the present invention, the insert can provide additional support to the drum so that even with a thinner drum, the drum is less susceptible to deformation.

In a presently preferred form of the invention, the insert is in the form of a solid cylindrical slug, however, a porous or foamed insert could also be formed. For example, a solid cylinder may be used if increased mass is desired, whereas a porous or foamed in place insert could be used if greater length along the inner portion of the drum with less mass or weight is preferred. A porous or foamed insert can be achieved through the use of blowing agents mixed with the resin in an amount <1 wt. % in proportion to the resin so that, during injection molding, structures with high levels of porosity result. Insert materials other than thermoplastics or thermoset resins (filled or unfilled) could also be used which possess thermal expansion coefficients sufficient to ensure that the insert is not later loosened from the internal sections of the photosensitive drum. Other organic or inorganic materials could also be used which flow for use in an injection-like process and still cure or solidify rapidly. In order to resist or counteract shrinkage which can occur during curing of the insert material, an additive can be included in the insert material, such as an expanding monomer and/or hollow spheres. For example, expanding monomers as disclosed in Expanding Monomers: Synthesis, Characterization, and Applications, p. 36–37 can be utilized. Presently, Spiro-7 oxabicyclo [4.3.0]nonane-8, 2'-(1', 3')-dioxalane; Spiro-7, 9-dioxacyclo [4.3.0]nonane-8, 2'-1'-oxacyclo-pentane; Spiro-1, 3-dioxalane-2, 1'-(3H)-isobenzofuran; or Spiro-7, 9-dioxabicyclo [4.3.0]nonane-8, 8'-7'-oxabicyclo [4.3.0] nonane are believed preferable as expanding monomers, however other expanding monomers are possible. In addition, or alternatively, hollow spheres (either filled hollow spheres or unfilled hollow spheres) such as hollow spheres manufactured by the PQ Corporation could also be utilized to inhibit or counteract shrinkage. If the spheres are filled, they can be filled, for example, with an oligomer of isobutylene.

In order to inject the insert material, a thermoset or thermoplastic cap-like plug or spacer of appropriate diameter is placed at a predetermined location within one end of the OPC drum. Once the spacer is in place, filling is accomplished using a hollow piston-like device with a nozzle opening on an additional plastic cap-like plug or spacer having an opening through which the nozzle injects the insert material. This arrangement and method ensure that the filling material can be forced into the OPC drum without flowing out of the ends of the drum. This arrangement and method also allows the insert material to be injected into the drum while the drum is horizontal, which is a typical orientation of the drum in automated assembly equipment used for attaching flanges/gears to the drums. Thus, once the insert material is injected into the drum, the drum can then quickly proceed to subsequent automated assembly operations including the insertion/attachment of flanges or gears into the ends of the drums. It is to be understood that it is also possible to inject the filler material of the present invention while the drum is vertical or at positions between vertical and horizontal.

To ensure that the proper amount of material fills the hollow OPC tube, a metering pump or other suitable means may be employed to dispense a predetermined volume of material within a specific time (preferably less than 6 seconds and more preferably within 2–3 seconds). Once the material is dispensed, it should cure or solidify as quickly as possible, such that there is little or no flow of the filling material immediately thereafter. The length of the injected insert can vary based on several factors including the vibrational frequency, desired mass, simplicity of fabrication and insertion, etc. It is presently preferred for the injected insert to extend over at least one-half of the length of the drum.

The arrangement of the present invention is advantageous in a number of respects. First, one can vary the mass/frequency characteristics of the drum, to thereby ensure that the resonance frequency of the drum is outside of the audible range, or does not match the resonance frequency of other components of the apparatus. Further, since the injected or cast insert is relatively light in weight, it can be distributed or extended along a majority of the length of the drum, thereby preventing disadvantages associated with prior plug-type inserts in which the plug or weight is concentrated at a specified location within the drum. The arrangement is further desirable over plug-type inserts in that the tendency of the injection filled cast insert is to expand (radially) upon injection such that the insert is held in place inside of the drum. Even if there is some shrinkage, since the insert is injected/formed inside of the drum, it can remain adhered to the drum interior. Accordingly, a separate adhesive is not required either for holding the insert inside of the drum or for holding the insert together.

The arrangement of the invention is also advantageous in that the insert need not be manufactured as a separate part, and thus, the cost associated with obtaining tooling for making of the inserts and the cost of inventory are avoided. The invention is further advantageous in this regard in that if a modification to the insert is needed (e.g., in the thickness, length, weight, etc.), such a modification can be made to the insert (e.g., by selecting a different filler material to form the injected cast insert, or by varying the amount of material injected) more readily than making a modification to the photosensitive drum itself, or in modifying the design of performed inserts. This aspect of the invention is particularly desirable in that an insert might be found to perform less than optimally after it has been used in the field.

However, even a slight modification to conventional inserts has required design and tooling changes. In accordance with the invention, a modification to an insert design can be readily achieved, simply by modifying, for example, the length along the drum into which the insert is injection molded. Thus, in addition to the simplicity and ease of fabrication, insertion and low cost, the invention is also advantageous in that design modifications, such as adjustments to the dimensions, volume and/or mass of the insert can be readily achieved without requiring new manufacturing tooling for the insert.

BRIEF DESCRIPTION OF THE DRAWINGS

Other objects and advantages of the present invention will become apparent as the same becomes better understood with reference to the following detailed description, particularly when considered in conjunction with the drawings in which.

DETAILED DESCRIPTION OF THE PREFERRED EMBODIMENTS

Figure 1:
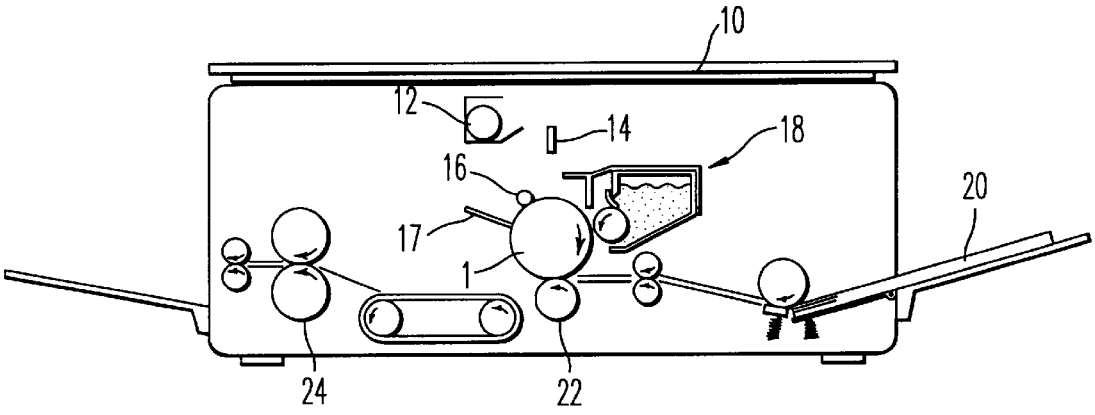
FIG. 1 schematically depicts a photocopier to which the present invention is applicable.

FIG. 1 schematically represents an image forming apparatus in the form of a photocopier to which the present invention is applicable. In such an arrangement, an original document is placed upon the photocopier glass 10, and is illuminated by a lamp 12. The resulting light is then projected onto a photosensitive drum 1 by way of an optical system 14, and the drum has been previously charged utilizing a charge roller 16. As a result, an electrostatic latent image is formed on the drum 1, and a developing unit 18 then supplies toner to the drum 1 to develop the electrostatic latent image. Paper is fed from a source 20 by various rollers to a location between the drum 1 and a backup roller 22, so that the toner image of the drum is transferred to the paper. The paper is then fed to a fixing device 24 which, typically utilizing heat, fixes the toner image to the paper and the paper is then conveyed out of the apparatus. A cleaning blade 17 is provided downstream from the backup roller 22(i.e., downstream with respect to the direction of rotation of the drum 1), so that any residual toner remaining on the drum after the image is transferred to the sheet is removed by the cleaning blade 17. The toner removed by the blade then falls into a container (not shown) provided for collecting residual toner. The drum is then charged by the charger roller 16, and the process is repeated for the next image.

Figure 2:
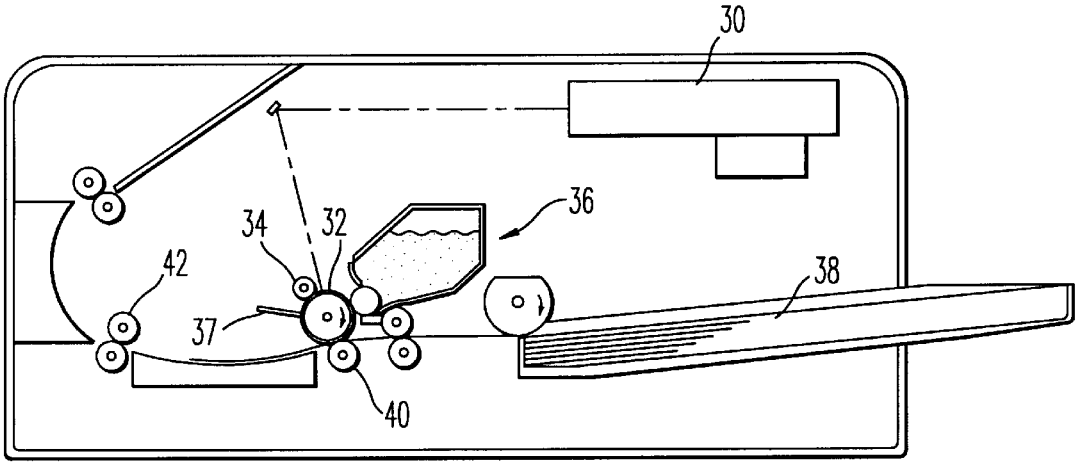
FIG. 2 schematically depicts a printer to which the present invention is applicable.

FIG. 2 schematically represents a printer device to which the present invention is also applicable. As shown in FIG. 2, in contrast with the photocopier device, the printer provides an image by way of a control unit that provides a video signal, for example, by a laser scanning unit 30. The laser scanning unit 30 thus provides a latent image onto the photosensitive drum 32, which has been uniformly charged by charge roller 34. The image is developed by a developing device 36, and is transferred to paper (fed from a source 38) as the paper passes between the photosensitive drum 32 and a backup roller 40. The paper then travels past a fixing device 42 and out of the printer by various conveying rollers and guides. Residual toner can be removed by a cleaning blade 37.

As should be apparent from the foregoing, the photosensitive drum is critical to the image forming process, and for each cycle of operation, the photosensitive drum is required to cooperate and interact with a number of components, including the charge roller, the optical image forming system, the developer device, the backup roller and the cleaning blade. As the drum rotates, it can also vibrate as a result of the drive utilized in rotating the drum, imperfections (eccentricities or asymmetries) in the drum and/or the gear flanges of the drum, etc. Further, where an AC current is applied to the charge roller 16, 34, the alternating charge can also have a tendency to cause vibration and/or noise during operation of the drum, as can the frictional contact of the drum with the various components including the cleaning blade, charge roller and developer device. The formation of an image has also been found to generate ozone gas, and this gas generation is also believed to be a potential cause for noise and/or vibration of the drum.

The generation of noise and/or vibration is often accompanied by deterioration in the image quality, since the drum is not smoothly and consistently interacting with the other components of the image forming apparatus. As a result, toner may appear in areas in which it is not desired (undesirable black spots), and/or toner will not appear in areas required for forming the image (undesirable white spots). Less than optimal images can also occur over a period of use as the circularity of the drum diminishes. In particular, after the drum has operated for a number of cycles, certain locations of the drum can become deformed so that the cylindrical shape of the drum becomes more imperfect. This loss of circularity also contributes to degradation of the image quality, and the loss of circularity can occur more rapidly if the drum vibrates, since the drum can be exposed to more concentrated forces or forces of a larger magnitude than would be the case if the drum were smoothly rotated. Of course, the generation of undesirable noise and vibration can also be an annoyance to the operator of the apparatus, or those in the vicinity of the apparatus.

In order to avoid or reduce noise, some equipment manufacturers have designed the drum so that the natural resonance frequency of the drum does not match that of any of the surrounding components, and also so that the natural resonance frequency of the drum is not in the audible range. As a result, if vibration should occur, it is less destructive, since the frequency does not match that of the surrounding components. In addition, the noise is not audible (or is less audible) to the operator or those in the vicinity of operation of the apparatus. However, if a noise problem is found to occur in existing equipment, it can be quite costly to redesign tooling necessary to change the dimensions (e.g., the tube thickness) of the drum. Moreover, the manufacture of drums becomes more complicated where different thicknesses must be provided for different equipment. This complexity is compounded where drums are manufactured as replacement parts, since a manufacturer of replacement parts might manufacture drums for a larger number of different model printers or copiers of different manufacturers.

Another approach to minimizing noise and/or vibration in photosensitive drums has been to insert a plug or weight (or multiple plugs or weights) at a predetermined location within the drum. However, this insert approach is disadvantageous in that it requires the manufacture of a separate part, and the part must be designed and suitable tooling must be procured to manufacture the part. Further, once the part is manufactured, if the performance is less than optimal, redesign and retooling can be required to improve the part. The use of a plug-type insert can also be undesirable in that the plug is typically required to be inserted at a particular axial location within the drum, and if improperly placed, the plug might not perform properly, and could even worsen the noise or vibration problems. In addition, often the plug must be adhered in place, or an interference fit must be utilized so that the plug is secured in place once inserted. Fixing the plug with an adhesive can be cumbersome, and could result in the adhesive being inadvertently disposed at locations other than desired (such as on the drum exterior which could adversely affect the drum performance), or the plug could shift if the drum is transported prior to curing of the adhesive. If an interference fit is utilized, the drum could be deformed upon insertion. Further, since the drum is supported at the location of the plug, but not in other areas, the performance and response of the drum at the location of the plug might not be consistent with that of other locations of the drum.

Figure 3A:
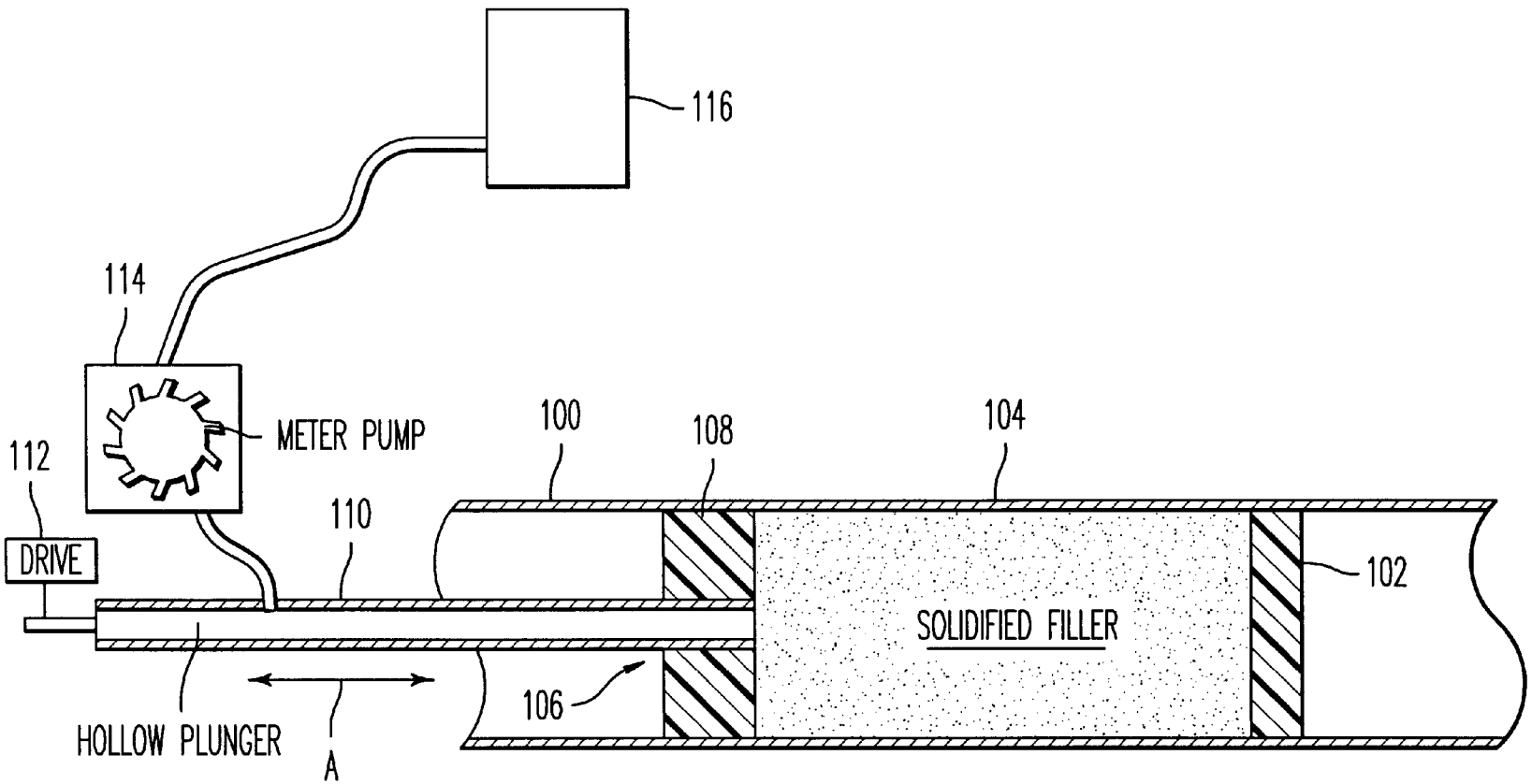
FIG. 3A illustrates the photosensitive drum and insert as well as the process and equipment for injecting an insert into a photosensitive drum in accordance with the invention.

Referring now to FIG. 3A, a drum in accordance with the present invention is depicted, as well as an arrangement and method for forming the insert in accordance with the present invention. In order to form the insert 104 within the drum 100, an end cap or plug 102 is preferably first inserted into one end of the drum. The cap or plug 102 can be an inexpensive thermoplastic or other material, and is used to ensure that once the insert material is injected into the drum at the correct location, it does not flow out of the end of the drum. The plug 102 can remain with the drum after the insert has been filled and cured. Alternately, the plug 102 could be removed, for example, by mounting the plug 102 upon a rod such that the plug serves as a back-up during formation of the insert and then is removed when no longer needed. If the plug is removed after each filling operation, a more durable, non-stick material is preferred, while a relatively inexpensive plug material which can adhere to the insert is preferred where the plug is to remain in the drum after filling. Once the plug 102 is in place, the injection and formation of the insert can proceed.

In a preferred form of the invention, the insert material is injected utilizing a nozzle 106 having a collar 108 of substantially the same size as the inner diameter of the drum 100. As a result, during filling, the insert material is formed at the desired location along the length of the drum and will not flow back around the nozzle or out of the end of the drum. The nozzle 106 is mounted upon a reciprocating plunger rod 110 which is hollow to provide a conduit for feeding the material to the nozzle 106. The plunger rod 110 reciprocates in the direction indicated by arrow A. When the insert material is initially injected, the nozzle 106 is disposed adjacent to the plug 102. As the injection/filling progresses, the plunger rod 110 and nozzle 106 are progressively retracted away from the plug 102 until the injection operation is completed. The filling operation will preferably require only two-three seconds, and thus does not present a significant delay in the drum assembly process. A suitable drive 112 is utilized for reciprocating the plunger rod 110. Such reciprocating drives are well known and drives similar to that used for drum gear flange insertion can be used. Thus, the invention can be compatible with existing equipment utilized in the assembly of drums, modified so that the reciprocating drive used for flange insertion also reciprocates the plunger rod 110, and, if desired, the insertion of plug 102.

A metering pump 114 feeds the insert material from a reservoir or supply 116 of the filler material. The metering pump can pump the material for a predetermined amount of time or can meter the material by volume. In either case, the amount of insert material which is pumped into the drum can be controlled and also can be varied so that different amounts of material can be pumped into different drum models. In addition, if it is desired to modify the amount of material which is to be injected into a drum, such a modification can be readily accomplished. Accordingly, it should be readily apparent that the present invention allows for the formation of inserts of various sizes without requiring design or tooling modifications in order to form such inserts. As should also be apparent, since the insert is formed within the drum, the insert will conform to the interior of the drum, and thus, it is not necessary to design tooling with precise manufacturing tolerances in order to form inserts of the correct size. Further, the location of the insert can be varied by varying the placement of the plug 102 and the stroke of the reciprocating plunger rod 110.

As discussed earlier, preferably the insert material is a one or two-part thermosetting resin which cures rapidly. Preferably, the total time for injection and curing of the insert material is less than 10 seconds, and more preferably less than 6 seconds. Materials which are suitable include polyesters, epoxy resins, or other thermosetting or thermoplastic resins, however other materials are also possible. In addition, the insert material will preferably include a filler material such as alumina or silica so that the thermal expansion of the insert more closely matches that of the drum 100. Such thermal expansion compatibility is important so that the insert does not become dislodged from the drum and does not deform the drum when exposed to hot or cold temperatures during shipping or storage. Drums can be exposed to high and low temperatures during shipping as air cargo or during storage in warehouses which are not heated or air conditioned. The use of fillers in amounts of as small as 5% by weight have been found advantageous in making the thermal expansion of the insert more closely match that of the drum. Preferably, the amount of filler material will not exceed 90% by weight so that the filler material does not unduly disturb the ability of the filler material to flow and thus be fed into the drum. As discussed earlier, if the insert material shrinks a small amount the insert should nevertheless remain adhered to the interior of the drum. However, it can also be desirable to include expanding monomers (e.g., Spiro-7 oxabicyclo [4.3.0]nonane-8, 2'-(1', 3')-dioxalane; Spiro-7, 9-dioxacyclo [4.3.0]nonane-8, 2'-1'-oxacyclopentane; Spiro-1, 3-dioxalane-2, 1'-(3H)-isobenzofuran; or Spiro-7, 9-dioxabicyclo [4.3.0]nonane-8,8'-7'-oxabicyclo [4.3.0]nonane) to compensate for shrinkage which could occur upon curing of the insert material. As an alternative to the use of expanding monomers, or in addition to the use of expanding monomers, other expedients for resisting or counteracting shrinkage can be utilized. For example, hollow spheres can be added to the flowable material which forms the insert upon curing, such as hollow spheres manufactured by PQ Corporation. The hollow spheres can either be filled or unfilled. If the hollow spheres are filled, they can be filled e.g., with an oligomer of isobutylene.

Figure 3B:
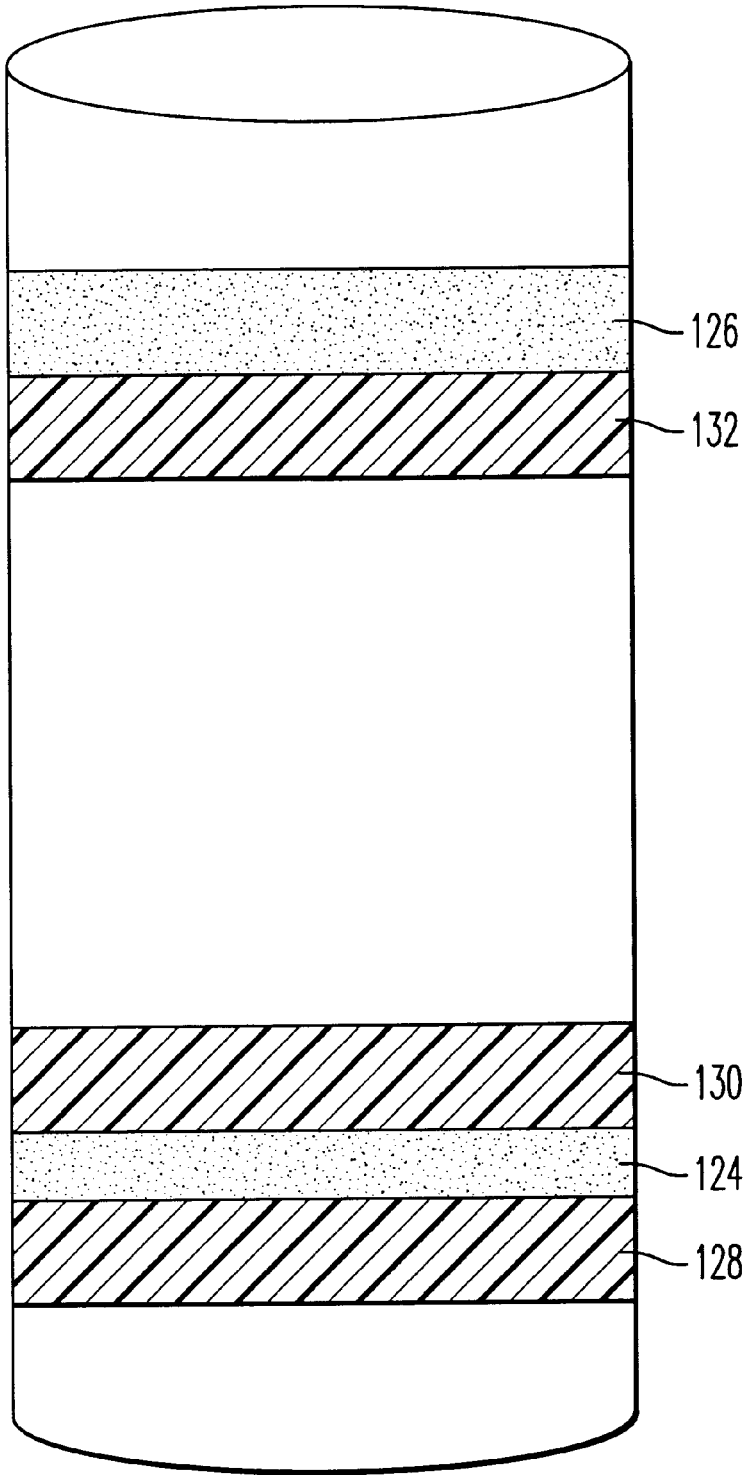
FIG. 3B depicts an alternate embodiment of a drum with plural inserts in accordance with the invention.

Referring now to FIG. 3B, an alternate embodiment of the invention is shown. In this embodiment a double insert is provided. In particular, inserts 124, 126 are provided at spaced locations along the length of the drum. Although relatively short inserts 124, 126 are shown, it is to be understood that the sizes of the inserts can vary, as can the placement locations. The insert can be formed by initially placing a cap 128 inside of one end of the drum, followed by filling of the insert material to form insert 124. A further cap or plug 130 can then be placed adjacent to the insert 124 if desired to ensure that the insert 124 will not deform prior to curing. The next plug 132 can then be installed, followed by filling of the insert material to form insert 126, and optionally, placement of a further plug or cap (not shown). Alternatively, the inserts 124, 126 can be formed at the same time. With the simultaneous formation, the plugs 130, 132 can be initially inserted. Next, filling nozzles can be inserted into each end of the drum to inject and form the inserts 124, 126 at the same time. Optionally, caps or plugs as shown at 128 can then be inserted into each end of the drum.

Obviously, numerous modifications and variations of the present invention are possible in light of the above teachings. It is therefore to be understood that, within the scope of the appended claims, the invention may be practiced otherwise and as specifically described herein.

What is claimed as new and desired to be secured by Letters Patent of the United States:

1. A method of forming a photosensitive drum with an insert comprising:

providing a photosensitive drum having inner and outer surfaces;

injecting a flowable material into an interior of said photosensitive drum such that said inner surface of said photosensitive drum provides a mold for said flowable material; and allowing said flowable material to solidify within said photosensitive drum.

2. A method as recited in claim 1, wherein the step of injecting said flowable material includes injecting a resin.

3. A method as recited in claim 2, wherein the resin includes a filler material selected from the group consisting of alumina and silica.

4. A method as recited in claim 3, wherein said filler material is 5%–90% by weight of the flowable material.

5. A method as recited in claim 1, further including:

inserting a plug into said photosensitive drum prior to the step of injecting a flowable material;

inserting a nozzle into said drum and positioning said nozzle adjacent to said plug; and injecting said flowable material through said nozzle while retracting said nozzle away from said plug.

6. A method as recited in claim 5, further including:

providing a collar about said nozzle to prevent backflow of said flowable material.

7. A method as recited in claim 1, wherein the step of injecting said flowable material comprises:

inserting a nozzle into said drum; and injecting said flowable material into said drum while retracting said nozzle.

8. A method as recited in claim 7, further including:

controlling an amount of said flowable material injected by said nozzle utilizing a metering pump.

9. A method as recited in claim 8, further including:

providing a collar about said nozzle to prevent backflow of said flowable material.

10. A method as recited in claim 1, wherein the step of injecting said flowable material includes injecting a flowable material which includes at least one of: (a) expanding monomer, and (b) hollow spheres.

11. A photosensitive drum for an image forming apparatus comprising:

(a) a tubular photosensitive member having:

(i) an outer photosensitive surface; and (ii) an inner surface; and (b) an insert comprising a rapidly solidifying material which is injected inside of said tubular photosensitive member and which solidifies inside of said tubular photosensitive member, wherein said insert is molded in said inner surface of said tubular photosensitive member.

12. A photosensitive drum as recited in claim 11, wherein said insert extends along a majority of the length of said tubular photosensitive member and is disposed at a predetermined position within said drum.

13. A photosensitive drum as recited in claim 11, wherein said insert comprises a flowable material which cures rapidly and which upon curing exhibits an exotherm of less than 80° C.

14. A photosensitive drum as recited in claim 13, wherein said flowable material cures in less than 10 seconds inside of said tubular photosensitive drum.

15. A method as recited in claim 13, wherein said flowable material comprises a thermosetting resin and a filler material.

16. A method as recited in claim 15, wherein said filler material is 5%–90% by weight of said flowable material.

17. A method as recited in claim 16, wherein said filler material is selected from the group consisting of alumina and silica.

18. A method as recited in claim 13, wherein said flowable material includes an expanding monomer.

19. A method as recited in claim 13, wherein said flowable material includes hollow spheres.

20. A method as recited in claim 19, wherein said hollow spheres are filled with an oligomer of isobutylene.

* * * * *